US006065623A

United States Patent [19]

Hierzer et al.

[11] Patent Number: 6,065,623

[45] Date of Patent: May 23, 2000

[54] CLOSURE WITH LENTICULAR LENS INSERT

[75] Inventors: Valentin Hierzer, Arlington Hts.; Steve Sungsuk Kim, Wheeling, both of Ill.

[73] Assignee: Crown Cork & Seal Technologies Corporation, Alsip, Ill.

[21] Appl. No.: 09/023,539

[22] Filed: Feb. 13, 1998

[51] Int. Cl.[7] ..... B65D 39/00

[52] U.S. Cl. ..... 215/230; 215/252; 40/311; 40/454

[58] Field of Search ..... 215/228, 230, 215/252; 40/310, 311, 453, 454

[56] References Cited

U.S. PATENT DOCUMENTS

| | | | |
|---|---|---|---|
| D. 249,935 | 10/1978 | Williams . | |
| D. 315,507 | 3/1991 | Ochs . | |
| D. 318,804 | 8/1991 | Ochs . | |
| D. 353,521 | 12/1994 | Booten . | |
| D. 359,685 | 6/1995 | Luch . | |
| D. 389,062 | 1/1998 | Ekkert et al. . | |
| 1,395,594 | 11/1921 | Pfefferle . | |
| 1,735,431 | 11/1929 | Goertz . | |
| 1,975,703 | 10/1934 | Vitale . | |
| 2,997,788 | 8/1961 | Gilbert . | |
| 4,034,882 | 7/1977 | Wright . | |
| 4,356,935 | 11/1982 | Kamin . | |
| 4,389,802 | 6/1983 | McLaren et al. | 215/230 X |
| 4,408,702 | 10/1983 | Horvath . | |
| 4,420,527 | 12/1983 | Conley . | |
| 4,541,727 | 9/1985 | Rosenthal | 40/454 X |
| 4,747,499 | 5/1988 | Gach et al. . | |
| 5,113,213 | 5/1992 | Sandor et al. . | |
| 5,273,173 | 12/1993 | Debetencourt | 215/252 |
| 5,285,238 | 2/1994 | Quadracci et al. . | |
| 5,456,375 | 10/1995 | May | 215/252 |
| 5,592,766 | 1/1997 | Mygatt | 40/311 X |
| 5,839,592 | 11/1998 | Hayes | 215/230 |

OTHER PUBLICATIONS

QDI refines focus; dimensional imaging sales takeoff, QDI, Nov./Dec. 1995.

*Primary Examiner*—Stephen K. Cronin
*Attorney, Agent, or Firm*—Woodcock Washburn Kurtz MacKiewicz & Norris LLP

[57] ABSTRACT

A dispensing package closure with a lenticular lens insert wherein the closure includes a retaining ring for easy positioning and secure attachment of the lenticular lens to the closure top. The closure with lenticular lens insert provides a selected visual effect whereby the lenticular lens provides the illusion of three dimensional images, moving images, or multiple images when viewed from different angles. The enhanced visual appearance of the closure with lenticular image increases the saleability and marketability of products sold in dispensing packages sealed with the closure with lenticular lens insert.

17 Claims, 4 Drawing Sheets

CLOSURE WITH LENTICULAR LENS INSERT

BACKGROUND

The invention relates to a dispensing package closure with a lenticular lens insert wherein the closure has a retaining ring adapted to receive and hold a lenticular lens in place atop the closure. Traditional closures have been bland and visual unappealing, only varying in shape or color, and generally not enhancing the image and marketability of the product and packaging. The invention herein solves this problem by providing a closure adapted to receive a lenticular lens insert. The lenticular lens provides a variety of visual effects such as the illusion that an object is three-dimensional, in motion, or providing multiple images as the lens is viewed at different angles. Although it is known to use lenticular imaging to enhance the visual appeal of product packaging, lenticular images have not been applied to closures and there are no closures available which are adapted to receive lenticular images. The invention herein solves this problem by providing a closure adapted with retaining ring to receive and hold a lenticular lens image.

SUMMARY OF THE INVENTION

It is the primary object of the present invention to incorporate lenticular lens imaging into the dispenser packaging market by providing a dispenser package closure with a lenticular lens insert. The closure with lenticular lens insert will provide appealing visual properties to the closure such that the closure will enhance the marketability and saleability of products having a lenticular lens closure. The invention is of particular value with respect to products oriented towards children in that lenticular imaging is particularly eye catching to them. In this respect it is desirable to have packaging that is attractive to children such as by providing lenticular lens inserts having images of familiar cartoon characters, action heros or other figures to which children are receptive.

A closure with lenticular lens insert of the present invention comprises a top and an annular skirt extending downward from the top to form a closure of the type ordinarily used to seal soda, water, medicine bottles and the like. The annular skirt preferably includes a means of resealably securing the closure to a dispenser package. The upper surface of the closure top includes an integrally molded retaining ring extending upwardly from the upper surface of the top and adapted to receive a lenticular lens insert.

The retaining ring is shaped such that the inside wall of the retaining ring corresponds in shape to the outside perimeter of the desired lenticular lens insert. The retaining ring extends upwardly from the surface of the top to form a cavity suitably shaped to receive and secure a lenticular lens insert so that in manufacturing the closure with lenticular lens insert the lens can be quickly and easily positioned inside the retaining ring and affixed to the closure top without shifting. The lenticular lens insert may be affixed to the top of the closure with an adhesive, such as a pressure sensitive adhesive. The retaining ring in conjunction with the adhesive prevents easy removal of the lenticular lens from the finished closure.

The resealable closure means for securing the closure to the dispensing package neck can be of any type typically known. For example, the skirt and dispenser package may have interengaging opposing threaded surfaces so that the closure can be screwed on and off the dispenser package. Alternatively, the dispenser neck may have a protuberance or indentation which interengages a corresponding opposing indentation or protuberance on the closure skirt, so that the closure can snap on and off the dispensing package.

In accordance with further embodiments of the invention, the closure can be provided with a tamper evident ring which indicates whether the closure has been tampered with after it was originally sealed. For example, the tamper evident ring may comprise a resilient tubular ring circumferentially engaging and frangibly connected to the bottom of the closure skirt. The tamper evident ring has a flange, which when placed on the dispensing package, hooks under a lug on the dispensing package neck. When the closure is placed on the dispensing package, the frangible connection remains intact, however, when the closure is subsequently removed, the protuberance of the tamper evident ring hooks under the lug of the dispenser package breaking the frangible connection as the closure is removed. The broken frangible connection indicates that the original seal has been broken.

The closure as disclosed herein is preferably molded as a single piece from a plastic material, such as polypropylene. The lenticular lens insert is separately manufactured. The lenticular lens is formed from a base image film and a substantially transparent optical coating formed over the image film. The base image film consists of two or more interleaved images. The optical coating is preferably formed from a substantially transparent thermosetting polymer. The polymer coating has a non-planar surface defining a series of elongated parallel lenticular formations of narrow width and substantially uniform size and shape, forming parallel lenses. These parallel lenses have a predetermined focal length correlated with the thickness of the composite lenticular sheet so as to focus substantially at the surface of the base film. When viewed at a particular angle, the parallel lenses of the optical coating focus on the corresponding interleaved portions of one of the images. As the viewing angle changes the lenses focus on the interleaved portions of other images contained on the base image film.

These and other features, aspects, and advantages of the present invention will become better understood with regard to the following description, appended claims, and accompanying drawings.

DETAILED DESCRIPTION

Figure 1:
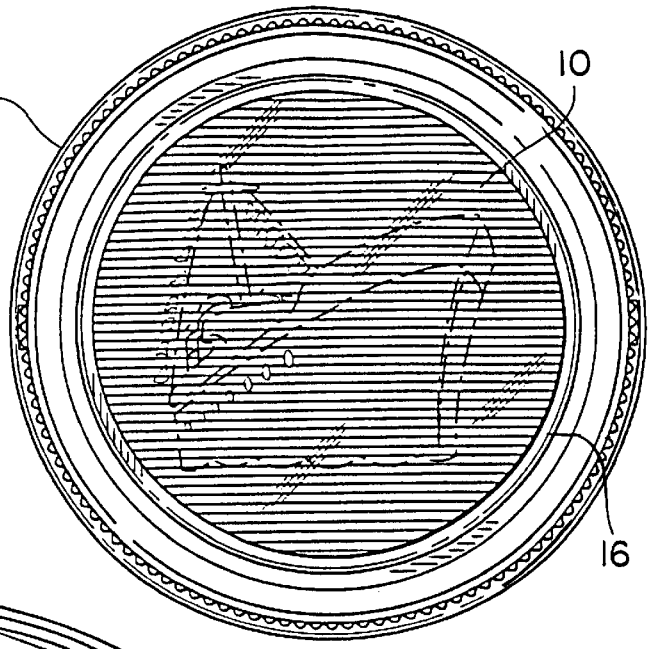
FIG. 1 shows a top plan view of the closure with a lenticular lens.
Figure 2:
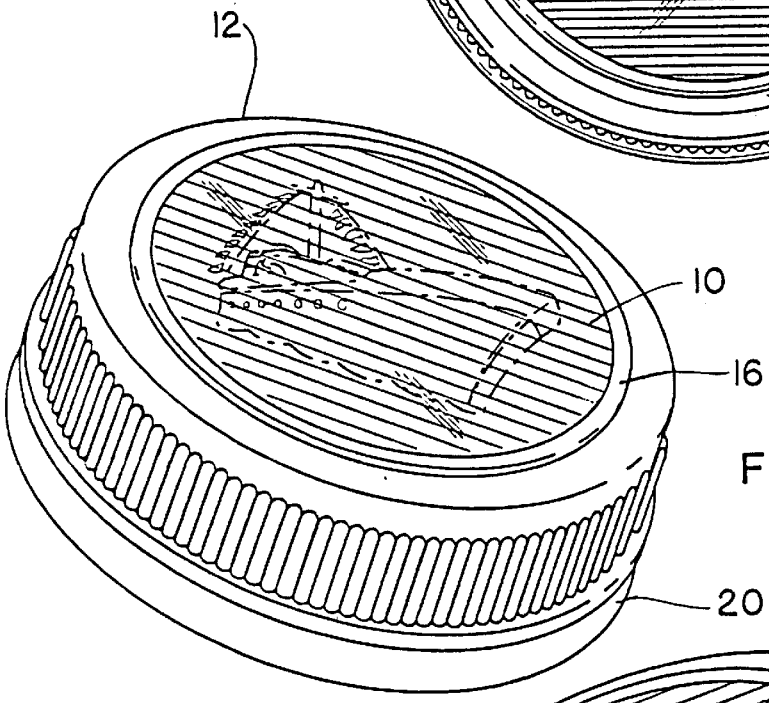
FIG. 2 shows a perspective view of the closure with the lenticular lens.
Figure 3:
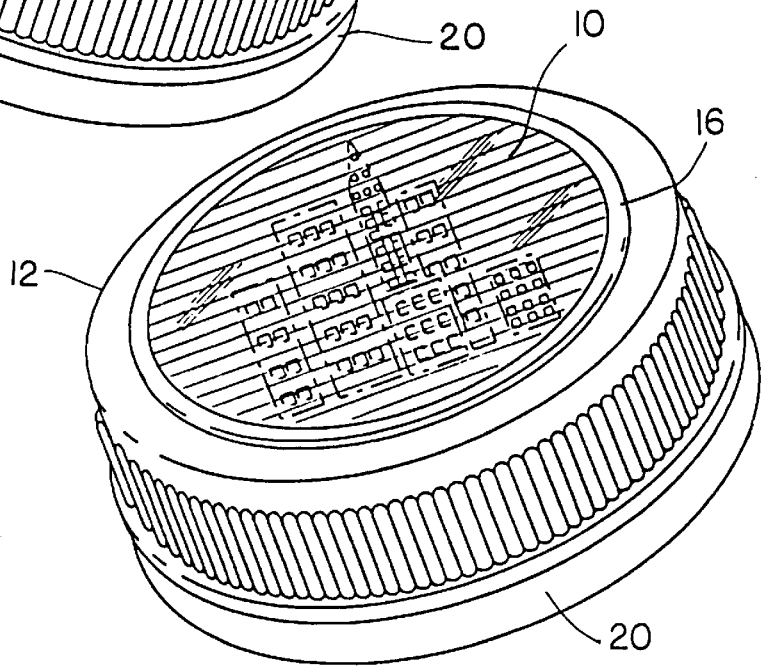
FIG. 3 shows a perspective view of the closure with an alternate lenticular lens.
Figure 4:
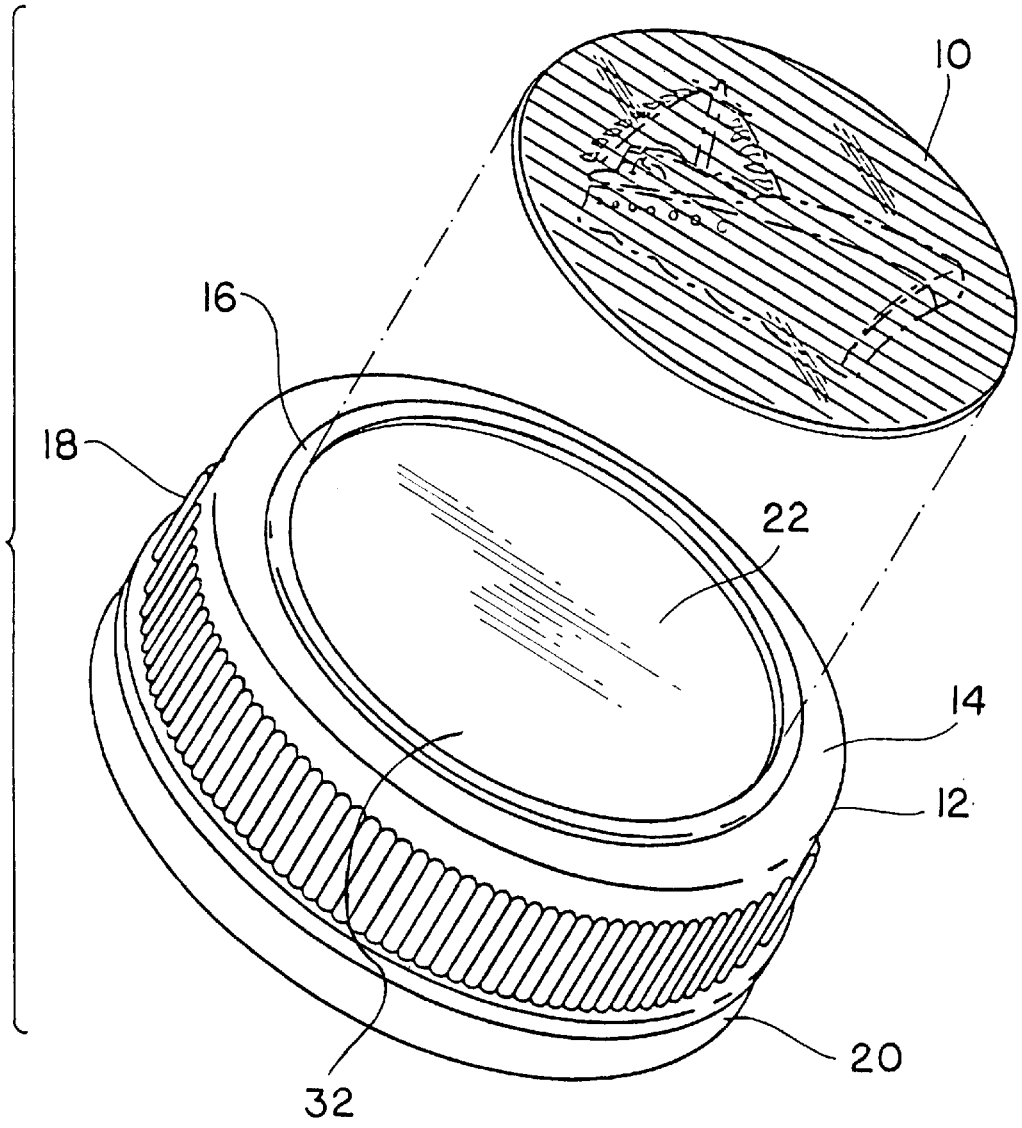
FIG. 4 shows an perspective exploded view of the closure with lenticular lens.
Figure 5:
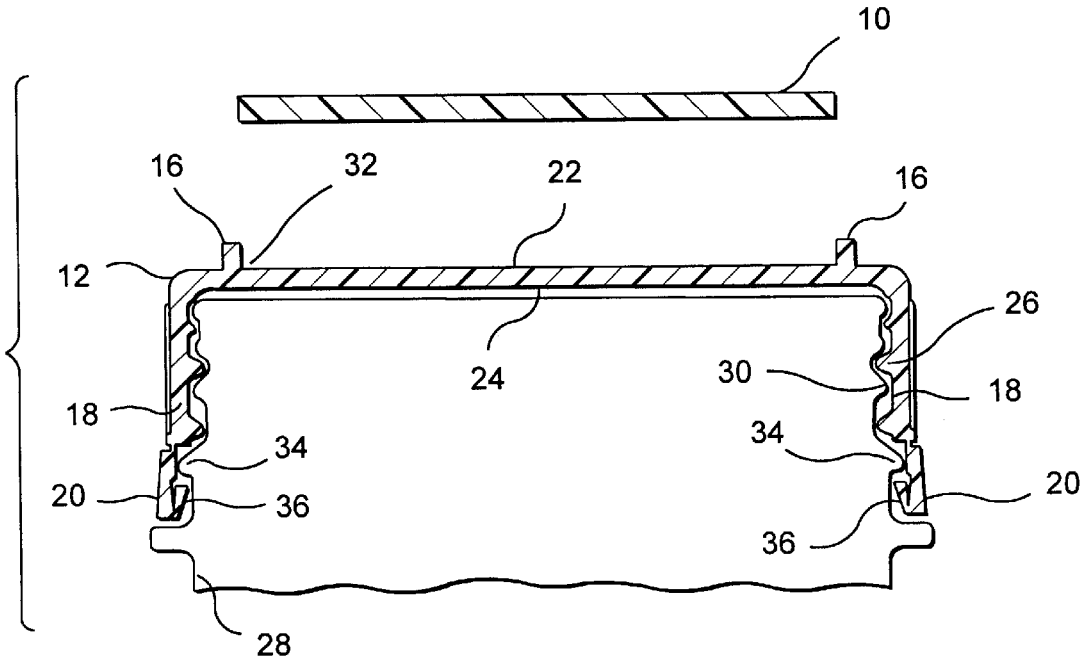
FIG. 5 shows a cross sectional view of the closure with lenticular lens.
Figure 6:
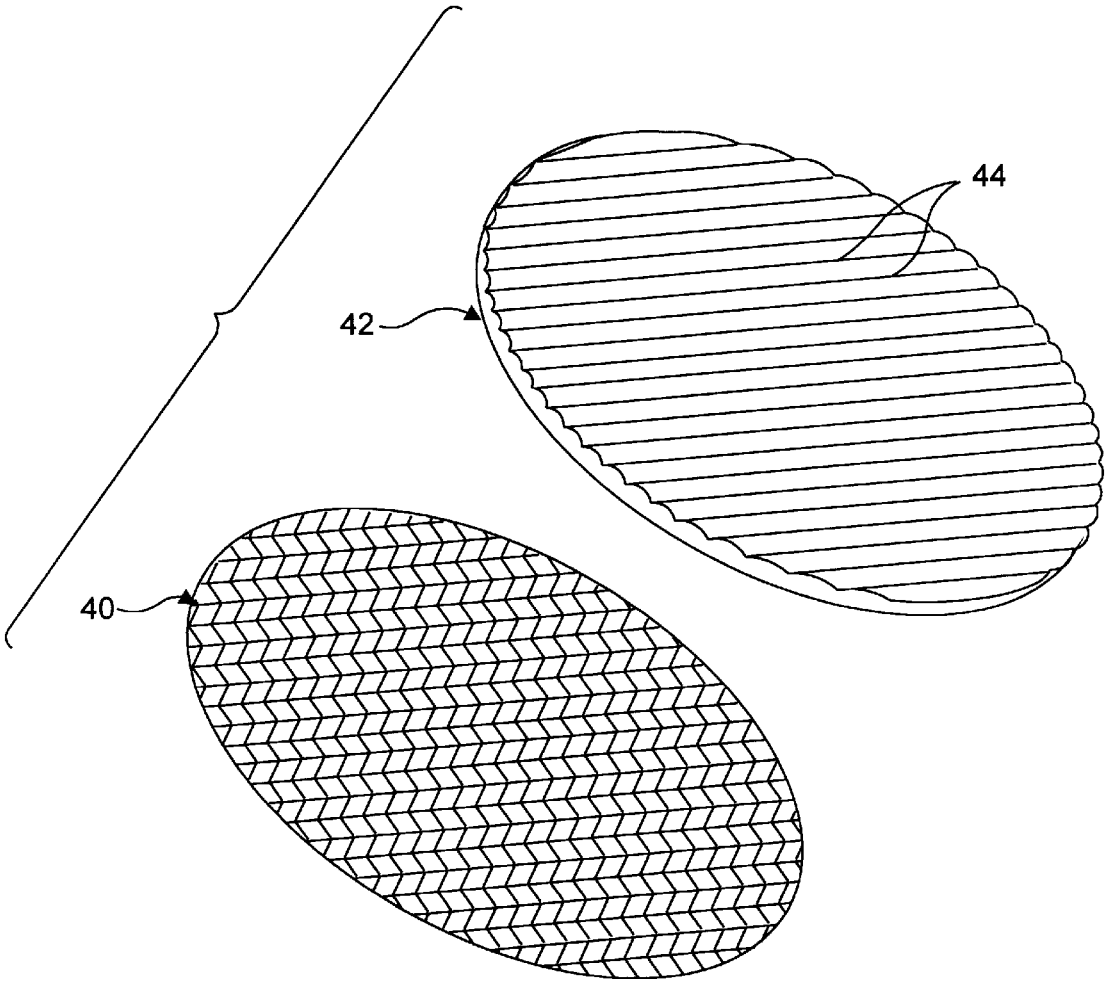
FIG. 6 shows an exploded view of a lenticular lens

In the drawings, with reference to FIGS. 1–6, a closure 12 is shown, adapted with a retaining ring 16 for receiving, positioning and securing a lenticular lens 10. The closure with lenticular lens insert is intended for use with dispensing packages 28, such as those used for soda bottles, juice, water, medicine bottles and the like.

The preferred closure 12 comprises a top 14 having an upper surface 22 and a lower surface 24, a retaining ring 16 extending upwardly from the upper surface 22, a tubular skirt 18 extending downwardly from the lower surface 24, and is preferably formed from a single piece of plastic, such as polypropylene.

The retaining ring 16 extends upwardly from the upper surface 22 of the top 14 and is shaped to correspond to the outside perimeter of the lenticular lens 10. It is preferable that the retaining ring extend upwardly to a height approximately equal to the thickness of the lenticular lens insert 10 so that the inside perimeter of the retaining ring 16 and the upper surface 22 of the top 14 form a cavity 32 sized to securely receive the lenticular lens 10. The retaining ring 16 serves to position and secure the lenticular lens 10 to the top 14, and prevents shifting of the lens during its application to the closure.

The lenticular lens 10 is composed of at least two alternately interleaved images forming a base image film 40 and an optical coating 42. The interleaving process is preferably performed on a computer with commercially available image editing software, however, interleaving can also be accomplished by manual means during or after the creation of the individual images.

The optical coating 42 is preferably formed from a substantially transparent thermosetting polymer. The polymer optical coating 42 forms a non-planar surface defining a series of elongated parallel lenticular formations of narrow width and substantially uniform size and shape, forming parallel lenses 44. These parallel lenses 44 have a predetermined focal length correlated with the thickness of the polymer optical coating so as to focus substantially at the surface of the base image film 40. The resulting base image film 40 and polymer optical coating 42 form the composite lenticular lens 10. The resulting lenticular lens 10 provides a desired three-dimensional image, moving image or multiple image visual effect.

The lenticular lens 10 is received by the cavity 32 created by the retaining ring 16 and the upper surface 24 of the top 12. A pressure sensitive adhesive on the back of the lenticular lens 10 is the preferred means of affixing the lens 10 to the top 12, however, other adhesives can be used or the lenticular lens 10 can be pressure fitted into the retaining ring 16 without the use of an adhesive.

The tubular skirt 18 extends downwardly from the lower surface of the top 24 and is sized to receive and seal the neck of a dispensing package 28. The tubular skirt 18 is preferably adapted with protuberances 26 and indentations 30 for engaging opposing protuberances and indentations on the dispensing package 28. The interengaging protuberances or indentation are preferably in the form of interengaging threads for resealably screwing the closure 12 on and off the dispensing package 28. The tubular skirt 18 having internal threads and the neck of the dispensing package 28 having opposing interengaging external threads.

The preferred embodiment also includes a tamper evident ring 20. The tamper evident ring 20 is circumferentially engaging and frangibly connect to the open end of the tubular skirt 18. The inner surface of the tamper evident ring 20 contains a flange 36 which when placed on the dispensing package 28 hooks under lug 34 on the neck of the dispensing package 28. The tamper evident ring 20 has sufficient resilience and elasticity so that the flange 36 having a diameter slightly smaller than the diameter of the lug 34 can be forced over the lug 34. The frangible connection can withstand the compression forces during application of the closure to the dispensing package 28 but yields under tension upon removal. In this respect, when the closure 12 is removed from the package the force required to pull the flange 36 over the lug 34 is greater than the force required to break the frangible connection. Accordingly, as the closure 12 is removed, the frangibly connection breaks, separating the tamper evident ring 20 from the closure 12. The tamper evident ring 20 remains on the neck of the dispensing package 28, indicating that the original seal has been broken.

Although a single preferred embodiment of the invention has been disclosed and described in detail herein it should be understood that this invention is in no sense limited thereby and its scope is to be determined by that of the appended claims.

What is claimed is:

1. A closure for use with a dispensing package having a neck comprising:

a top having upper and lower surfaces and a retaining ring extending upwardly from the upper surface to define a retaining ring height, the retaining ring having a uniform radial thickness throughout the retaining ring height;

a tubular skirt integrally molded with the top and extending downwardly therefrom, adapted to receive the neck of a dispensing package and having securement means for releasably attaching the closure to the dispensing package neck;

a lenticular lens mounted in the retaining ring on the upper surface of the top having imaging means for providing a selected visual effect, the retaining ring adapted to receive and position the lenticular lens on the upper surface of the top of the closure.

2. The closure according to claim 1, wherein the securement means for resealably attaching the closure to the dispenser package comprises interengaging surfaces on the closure skirt and dispensing package neck.

3. The closure according to claim 2, wherein the interengaging surfaces of the closure skirt and the dispensing package comprise mating threaded surfaces so that the closure can be screwed on and off the dispensing package neck.

4. The closure according to claim 2, herein the interengaging surfaces of the closure skirt and the dispensing package comprise at least one interengaging indentation and protuberance so that the closure can be snapped on and off the dispensing package neck.

5. The closure according to claim 1, further comprising a tamper evident ring frangibly connected to the tubular skirt whereby the frangible connection is broken when the closure is removed from the dispensing package neck so that evidence of tampering is visible.

6. The closure according to claim 1, wherein the closure is formed from plastic.

7. The closure according to claim 1, further comprising a pressure sensitive adhesive securing the lenticular lens to the upper surface of the top.

8. The closure according to claim 1, wherein the lenticular lens having imaging means comprises a flexible base image film and a layer of a substantially translucent, cured, thermosetting, polymer optical coating sealing the base image film.

9. The closure according to claim 8, wherein the base image film comprises a plurality of interleaved images.

10. The closure according to claim 8, wherein the polymer overlay has a non-planar surface defining a series of elongated parallel lenticular formations of narrow width and substantially uniform size and shape, forming parallel lenses having a predetermined focal length correlated with the thickness of the composite lenticular sheet so as to focus substantially at the surface of the base image film.

11. The closure of claim 1 wherein the retaining ring consists of a cylinder.

12. The closure of claim 11 herein the retaining ring cylinder defines a cylindrical inner surface, a cylindrical outer surface, and a top rim; each one of the inner surface and the outer surface connected to the upper surface and perpendicular thereto, the top rim connected between the inner surface and the outer surface.

13. The closure of claim 12 wherein the top rim is formed entirely between the inner surface and the outer surface.

14. The closure of claim 13 wherein the top rim is substantially even with an upper face of the lenticular lens.

15. The closure of claim 14 wherein the retaining ring has a rectangular cross sectional shape.

16. The closure of claim 14 wherein the lenticular lens has a circular perimeter.

17. The closure of claim 14 further comprising an adhesive securing the lenticular lens to the upper surface.

* * * * *

UNITED STATES PATENT AND TRADEMARK OFFICE

CERTIFICATE OF CORRECTION

PATENT NO. : 6,065,623
DATED : May 23, 2000
INVENTOR(S) : Hierzer et al.

It is certified that error appears in the above-identified patent and that said Letters Patent is hereby corrected as shown below:

Title page, column 2,
Line 2, "Attorney, Agent, or Firm" delete "MacKiewicz" and insert -- Mackiewicz -- therefor.

Column 1,
Line 9, delete "visual unappealing" and insert -- visually unappealing -- therefor.

Column 2,
Line 52, delete "an perspective" and insert -- a perspective -- therefor.

Column 3,
Line 57, delete "frangibly connect to" and insert -- frangibly connected to -- therefor.

Column 4,
Line 4, delete "the frangibly connection" and insert -- the frangible connection -- therefor.

Claims,
Column 4, claim 4,
Line 1, delete "herein" and insert -- wherein -- therefor.

Column 5, claim 12,
Line 1, delete "herein" and insert -- wherein -- therefor.

Column 6, claim 17,
Line 1, delete "claim 14" and insert -- claim 16 -- therefor.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*